United States Patent [19]

Chupka et al.

[11] 4,155,841

[45] May 22, 1979

[54] HIGH TURBULENCE SCREEN

[75] Inventors: David E. Chupka; Peter Seifert, both of Middletown, Ohio

[73] Assignee: The Black Clawson Company, Middletown, Ohio

[21] Appl. No.: 780,025

[22] Filed: Mar. 22, 1977

[51] Int. Cl.[2] ..... B07B 1/20

[52] U.S. Cl. ..... 209/273; 209/306; 210/415

[58] Field of Search ..... 209/273, 305-306; 210/415

[56] References Cited

U.S. PATENT DOCUMENTS

| | | | |
|---|---|---|---|
| 2,682,205 | 6/1954 | Vincent | 209/273 |
| 2,768,751 | 10/1956 | Booth | 210/497.1 |
| 3,276,584 | 10/1966 | Mathewson | 209/270 |
| 3,477,571 | 11/1969 | Maats | 209/273 |
| 3,561,605 | 2/1971 | Likness | 210/497.1 |
| 3,584,685 | 6/1971 | Boyd | 210/497.1 |
| 3,617,008 | 11/1971 | Lamort | 241/88 |
| 3,849,302 | 11/1974 | Seifert | 209/273 |
| 4,002,559 | 1/1977 | Paterson et al. | 210/415 |

*Primary Examiner*—Frank W. Lutter
*Assistant Examiner*—Jon E. Hokanson
*Attorney, Agent, or Firm*—Biebel, French & Nauman

[57] ABSTRACT

A method and apparatus for treating a suspension of liquid, paper making fibers and undesirable rejects to remove a substantial portion of the rejects from the suspension. A cylindrical screen is utilized which has narrow slots on the order of 0.001 to 0.008 inch in width disposed normally with respect to the screen axis, and bars projecting from the inlet face of the screen and cooperating with rotating foils for creating a field of high intensity, fine scale turbulence adjacent the inlet face of the screen. This permits the paper making fibers to pass through the narrow screen openings but causes very small reject particles, which would pass through the larger openings of conventional paper making screens, to be removed without fractionation of the paper making stock or appreciable variation in the consistencies of the feed, accepts and rejects.

10 Claims, 6 Drawing Figures

HIGH TURBULENCE SCREEN

BACKGROUND OF THE INVENTION

Conventional practice in preparing paper making stock is to feed a suspension of liquid and paper making fibers, which contains in varying degrees undesirable rejects, through a screen to remove at least a portion of the rejects before the stock is delivered to the forming surface of a paper making machine.

One popular type of screening apparatus utilizes a perforated, cylindrical screen into the interior of which is fed the unscreened paper making stock. Rejects are withdrawn from an end, usually the lower end, of the vertically oriented screen, while the accepts are passed through the perforations in the screen and collected. Additionally, rotating foils or other devices are positioned either inside or outside the screen surface, generally to alleviate plugging of the screen holes.

For example, in U.S. Pat. No. 3,617,008, a screen is disclosed which may have round holes or slots formed therethrough with the slots either horizontally or vertically oriented. A device such as a foil rotates over the inner or outer surface of the screen and flow impediments cooperate with the foils to cut off flow movement parallel to the surface of the screen and in some embodiments, to actually cooperate with the foils to sever filament shaped impurities in the product being screened.

While the size of the screen openings contemplated are not disclosed it may be assumed that the slots are, as is conventional, on the order of something in excess of 0.010 inch in width and thus, a substantial amount of the undesirable rejects below this size will pass through the screen with the accepts. Additionally, it is again not specifically disclosed but it may be assumed that, as in the case of conventional slotted cylindrical screens, a much higher than desirable removal of paper making fibers with the rejects would occur if an attempt were made to remove very small size rejects.

In U.S. Pat. No. 3,849,302, a commercially successful method and apparatus for screening paper making stock is disclosed. The apparatus includes a circular screen having vertically oriented slots and rotatable foils which move past the inner face of the cylindrical screen but are spaced a sufficient distance from the screen inner face to establish a tubular layer of stock adjacent the screen inner face. This provides improved screening results as compared to more conventional screens in which round holes are provided and, although it is stated in this patent that the vertical slot widths can be as low as 0.003 to 0.006 inch, it is also stated that as a practical and economic matter the slot widths should be in the range of approximately 0.010 to 0.030 inch.

Additionally, it has been found in subsequent development work that with vertical slots having a width much lower than 0.010 inch, only "fines" are accepted and an appreciable amount of the more desirable, longer, paper making fibers are lost along with the rejects. Aside from the loss of good fibers the use of narrower vertical slots in commercially available screens of this type results in a marked decrease in throughput rates since the percentage of accepts is necessarily relatively low as compared to the quantity of feed.

In order to circumvent the problems connected with extremely small perforations and still prevent small particles from passing through the openings, conventional screens have been designed to produce auxiliary screening effects. These may be classified into two groups. The first group claims to form a layer network of long fibers and reject particles on the inlet side of the screen cylinder. The openings of the network are claimed to be very small and represent the actual criteria which determines which particles are accepted or rejected rather than the size of the openings through the screen itself.

The second group of screens is based on the hypothesis that such a layer is ineffective and that the acceptance or rejection of a particle is determined by the size and shape of the opening in the screen cylinder. Designs are aimed at orienting elongated particles in such a way that the longest or broadest sides of the particles are presented to the opening — resulting in maximum probability for rejection. Without such specific orientation features, a long particle would orient itself parallel to the lines of flow through the openings, causing high probability for its acceptance — which is undesirable.

In these conventional screens, high turbulence next to the inlet side of the screen cylinder is, of course, detrimental to both mechanisms cited. In the first, the critical network would be destroyed; in the second, debris orientation would be more random, favoring passage of undesirable particles through the cylinder.

On the other hand, total lack of turbulence or fluid shear is also detrimental in these screens because this condition would allow fibers to form flocs which would be rejected by the screen, causing intolerably high fiber loss.

Conventional screens thus must feature a careful balance between the degree of turbulence and the size of openings employed. Small changes in operating condition can destroy the balance, resulting in either plugging of the screen or in highly-contaminated accepts.

In summary, although prior art screens disclose the use of horizontal slots, rotating foils and flow impediments such as bars fixed to the surface of the screen, and it is mentioned in one patent that vertical slots in a screen could be as small as 0.003 to 0.006 inch in width, as a practical matter it has been found that with prior art screens of this type the slots must be appreciably wider than this, generally wider than 0.010 inch, in order to prevent fractionation and permit sufficient paper making fibers to pass through the screen to provide an economical system.

This means that undesirable material smaller in size than the screen openings can and does pass through the larger openings of prior art screens of this type. Traditionally, therefore, it has been considered necessary that either an appreciable amount of undesirable rejects must be accepted to obtain required quantities of fibers of longer lengths or an appreciable amount of desirable fibers must be lost if smaller rejects are to be screened.

SUMMARY OF THE INVENTION

The present invention permits extremely fine screening of paper making stock at practical throughput rates and without substantial fiber loss or fractionation or appreciable variance in feed and accept consistencies through the use of a cylindrical screen having very narrow slots disposed normally with respect to the screen axis, and the generation of a field of high intensity, fine scale turbulence adjacent an inlet face of the screen.

In a preferred embodiment of the invention, the slots through the screen are on the order of 0.001 to 0.008 inch in width. Turbulence generating means is provided in the form of protrusions which extend from the inlet face of the screen and cooperate with means moving parallel to the screen inlet face, such as rotating foils, to generate in the paper making pulp adjacent the inlet face of the screen a field of high intensity, fine scale turbulence. That is, a field of turbulence in which the velocity of the particles of the suspension is rapid but of very small amplitude. Thus, rather than the large eddies associated with more generalized turbulent flow, high intensity, fine scale turbulence exhibits very small eddies, but of a very violent nature.

While the mechanism involved is not entirely understood at this point, it is believed that the generation of a field of high intensity, fine scale turbulence adjacent the inlet face of a screen provided with very narrow slots disposed normally to the screen axis insures that any solids within the suspension that have a dimension less that the slot width will pass through the slots, so that a true particle size separation is achieved, contrary to the operation of prior art screens of this general type.

Because of this the slots through the screen can be made much finer than in conventional paper making stock screens without appreciable loss of desirable paper making fibers but with the rejection of an appreciably increased amount of small size, undesirable rejects which would pass through the larger slots and holes of conventional screens.

While the slots in the screen of the present invention can be machined, it appears that a more practical method of forming the screen is to utilize closely spaced wire strand or rings with the spacing between either adjacent strand or rings being in a range of 0.001 to 0.008 inch.

Conveniently the desired spacing between adjacent strand or rings can be maintained by welding or otherwise affixing to the inlet face of the cylindrical screen defined by the strand or rings elongated, axially extending bars, which not only serve to fix the strand or rings in position and reenforce to entire screen, but cooperate with rotating foils or other means passing over the screen face to generate a field of high intensity, fine scale turbulence in the suspension adjacent the screen inlet face.

In summary, although prior art screens disclose the use of horizontal and vertical slots, rotating foils and flow impediments such as bars fixed to the surface of the screen, and it is mentioned that vertical slots in a screen could be as small as 0.003 to 0.006 inch in width, as a practical matter it has been found that with prior art screens of this type the slots must be appreciably wider than this, generally wider than 0.010 inch, in order to prevent fractionation and permit sufficient paper making fibers to pass through the screen to provide an economical system.

This means that undesirable material smaller in size than the screen openings can and does pass through the larger openings of prior art screens of this type. Traditionally, therefore, it has been considered necessary that either an appreciable amount of undesirable rejects must be accepted to obtain required quantities of fibers of longer lengths or an appreciable amount of desirable fibers must be lost if smaller rejects are to be screened.

From the above and following detailed description, it will be seen that the present invention provides a method and apparatus for especially fine screening of paper making stock at practical throughput rates and without fractionation of the accepts or appreciable variance between feed, accepts and rejects consistency.

DESCRIPTION OF THE PREFERRED EMBODIMENTS

Figure 1:
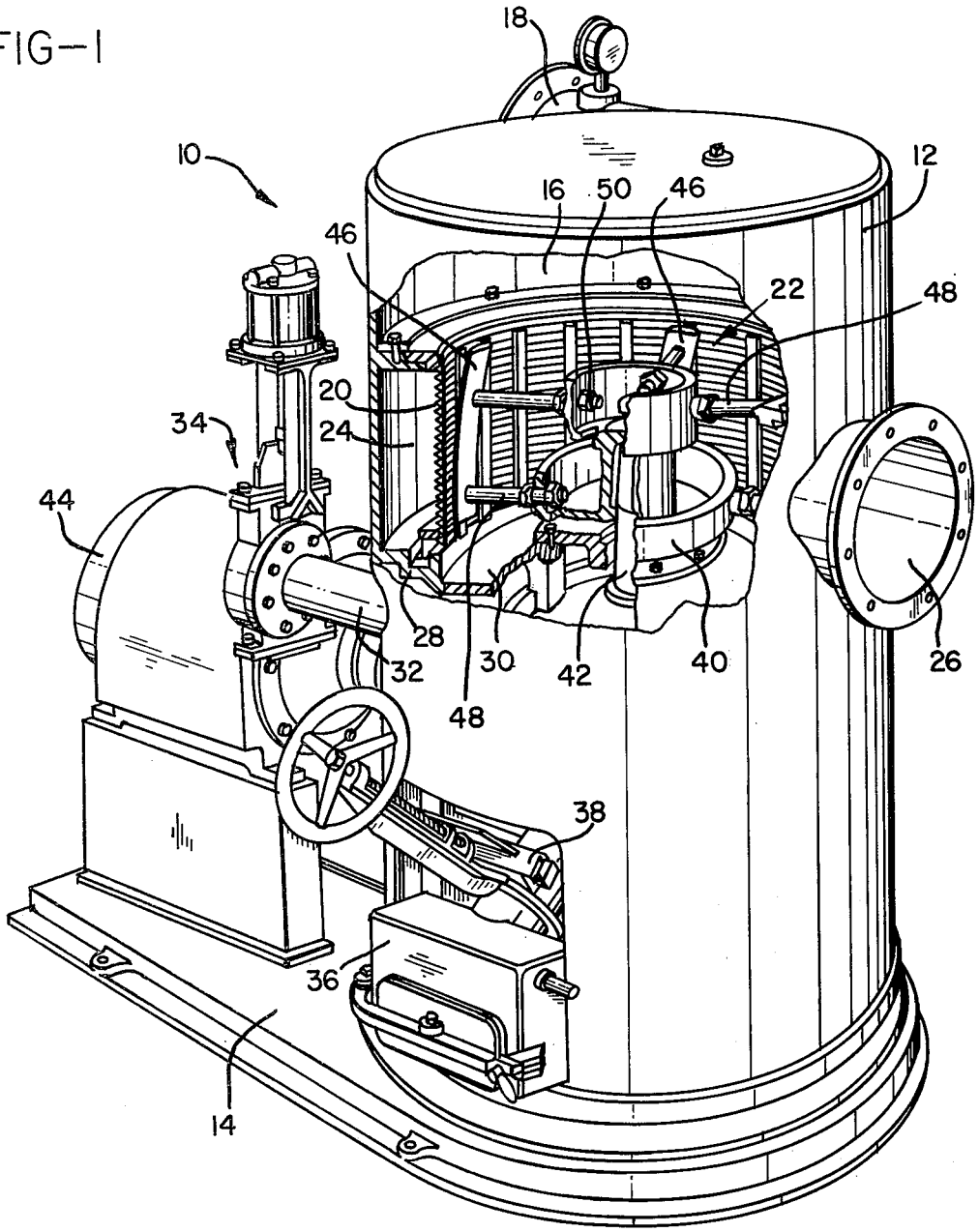
FIG. 1 is a perspective view of screening apparatus in accordance with the present invention.

The screening apparatus shown in FIG. 1 of the drawings is similar to that shown in the above noted U.S. Pat. No. 3,849,302 except for the incorporation of the screening cylinder of the present invention. Thus, the screening apparatus 10 includes a main housing 12 on a base 14 having an inlet chamber 16 in an upper end of the housing with a tangential inlet port 18 through which the paper making stock is fed under pressure into the screen housing.

The cylindrical screen 20 of the present invention is positioned within the housing such that it divides the housing into a central chamber 22 into which the stock is initially fed and an accepts chamber 24 communicating with an outlet port 26.

A bottom wall 28 of the chamber 22 has a trough 30 communicating with a discharge port 32 controlled by a valve assembly 34 which, as is conventional, can be preset to provide a desired continual bleed of rejects from the system. The trough 20 collects reject particles which drop from the trough into a collection box 36 upon opening of the manually controlled valve 38.

A rotor 40 is supported on a drive shaft 42 in the supply chamber and is driven by means of a motor 44 and suitable interconnecting gearing or the like. The rotor carries foils 46 mounted on the ends of support rods 48 which are provided with adjustable connections 50 to position the foils as desired with respect to the inner face of the screen 20.

Figure 2:
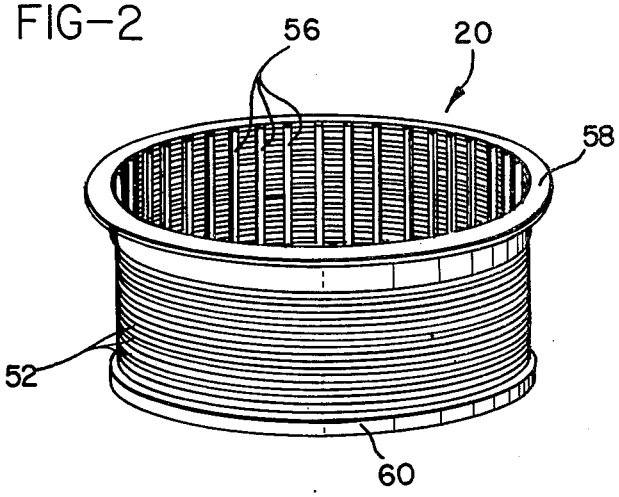
FIG. 2 is a perspective view of a screening cylinder in accordance with the present invention.
Figure 4:
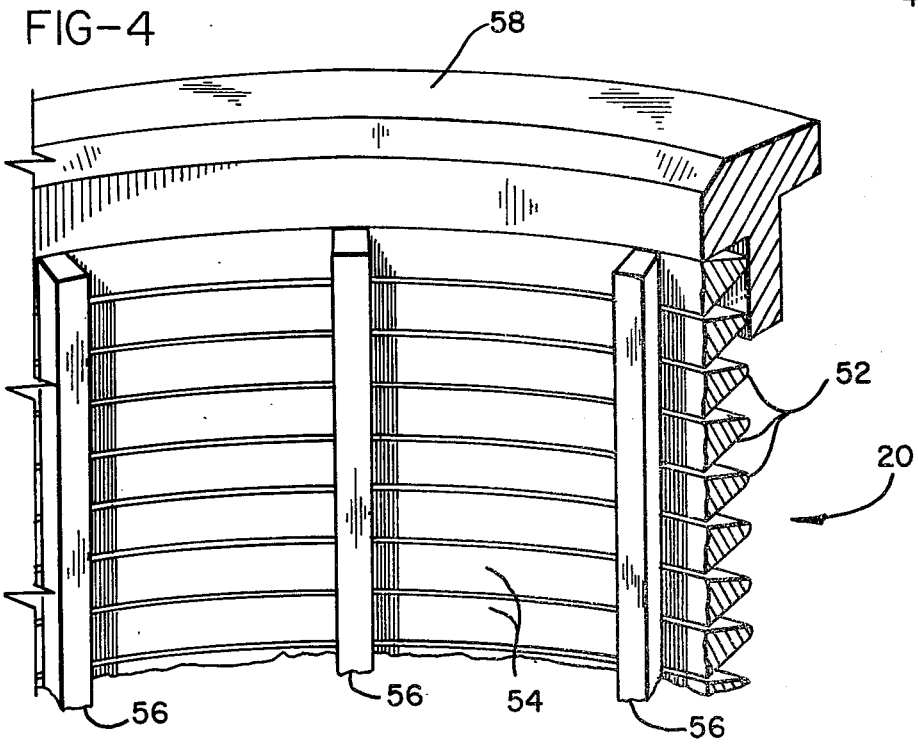
FIG. 4 is an enlarged view of a portion of the screen of FIG. 2.

As best seen in FIGS. 2 and 4 of the drawings, screen 20 includes a series of rings 52 which can conveniently be formed from generally triangularly cross-sectioned wire strand, although it will be apparent as the description proceeds that other members, such as annular discs, can be used to achieve the same results.

The rings 52 are laid up in a suitable jig which permits the rings to be spaced as necessary to provide slots 54 of the desired width. Thereafter bars 56 are secured to the inner face of the cylinder by welding or the like and mounting rings 58 and 60 secured to the upper and lower ends of the screen. The resulting structure is a screen having slots 54 normally disposed with respect to the longitudinal axis of the screen and of from 0.001 to 0.008 inch in width at their narrowest point and bars 56 projecting inwardly of the inner face of the screen.

Figure 3:
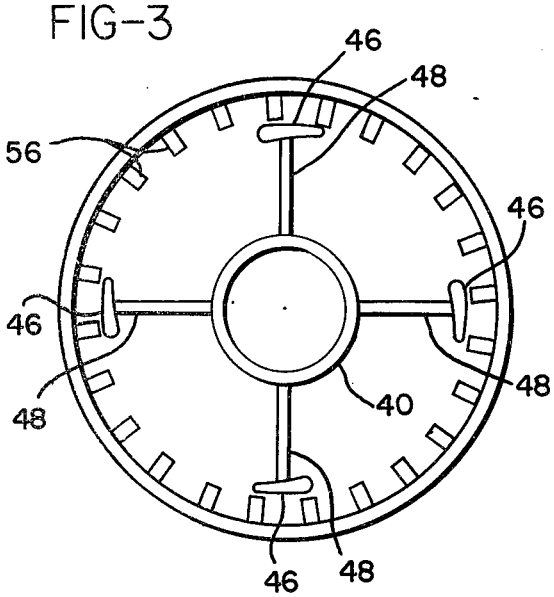
FIG. 3 is a plan view of the cylindrical screen of FIG. 2 showing its relationship to rotating foils positioned within the screen.

When the screen 20 is mounted in the housing 12 as shown in FIG. 1 of the drawings, the foils 46 of the rotor 40 cooperate with the inwardly projecting bars 56 as seen in FIG. 3 of the drawings to create a field of high intensity fine scale turbulence adjacent the inner face of the screen. As noted above, this permits a true particle size separation, which allows the slots 54 to be made exceedingly fine and provides practical screening on a scale heretofore considered impractical and uneconomic.

Figure 5:
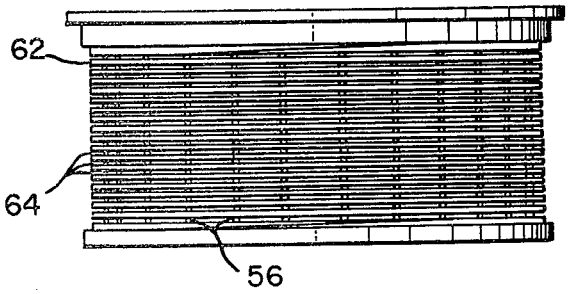
FIG. 5 is an elevational view showing a modified form of screening cylinder.

In the embodiments shown in FIGS. 2 and 4 of the drawings, the screen 20 is shown as formed of a series of rings spaced axially to provide the fine screening slots 54. Alternately, a single, continuous strand 62 may be utilized, as shown in FIG. 5, wound helically about the central vertical axis of the screen with adjacent turns spaced from each other to provide slots 64 of the desired width of 0.001 to 0.008 inch at their narrowest point. As in the embodiment of FIGS. 2 and 4, longitudinally extending bars 56 are utilized to both position adjacent strands and serve as the inward projections which cooperate with foils 46 to generate the field of high intensity, fine scale turbulence adjacent the inner face of the screen.

Figure 6:
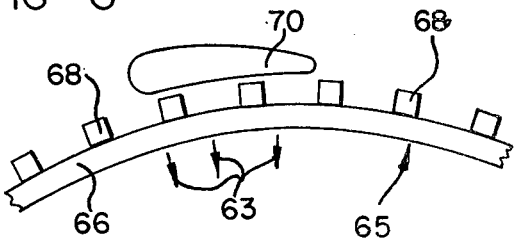
FIG. 6 is a fragmentary plan view showing a modification of the screening apparatus.

In the embodiments shown in FIGS. 1 through 5 of the drawings, the inlet face of the screen is its inner face. As will be apparent from FIG. 6 of the drawings, flow through the screens may be reversed as indicated by the arrows 63. In this embodiment the inlet face of the screen 64 is its outer face 66, and bars 68 are positioned on the outer face of the screen with foils, as indicated at 70, rotating past the outer face of the screen.

While the apparatus of the present invention as shown in FIGS. 1 and 3 of the drawings as including bars and rotating foils to produce the high intensity field of turbulence adjacent the screen inlet face it will be appreciated that other means of creating such turbulence can be utilized to the same effect within the scope of the present invention.

While the method and form of apparatus herein described constitute preferred embodiments of the invention, it is to be understood that the invention is not limited to this precise method and these forms of apparatus, and that changes may be made therein without departing from the scope of the invention.

What is claimed is:

1. In a method of treating on a continuous basis a suspension comprising liquid, paper making fibers having a distribution of various length fibers and undesirable rejects to remove a substantial portion of said rejects from said suspension, the improvement comprising:

delivering said suspension under pressure to the inlet side of a cylindrical screen having a longitudinal axis and having formed through it slots having a width of 0.001 to 0.008 inch disposed substantially normally to said longitudinal axis, generating in said suspension adjacent said inlet side of said screen a field of high intensity, fine scale turbulence, maintaining said field of high intensity, fine scale turbulence while passing through said slots at least a portion of said paper making fibers of said suspension, with said fibers passing through said slots having approximately the same distribution as the distribution of said paper making fibers delivered to said inlet side of said screen, thereby avoiding fractionation of the fibers passing through said slots, and removing from said inlet side of said cylindrical screen a substantial portion of said rejects.

2. The method of claim 1 wherein:

said steps of delivering said suspension to said screen and removing said rejects and paper making fibers from said screen comprises removing said rejects and paper making fibers with portions of said liquid at approximately the same consistencies as the consistency of said suspension delivered to said inlet side of said screen.

3. The method of claim 1 wherein said step of generating a field of high intensity, fine scale turbulence comprises:

positioning along said inlet side of said screen elongated members extending across said slots of said screen and projecting from said inlet side thereof, and moving adjacent said inlet side of said screen substantially parallel thereto means cooperating with said elongated members to cause said turbulence.

4. The method of claim 3 wherein said step of providing said elongated members and means cooperating therewith to produce said turbulence comprises:

providing said inlet side of said screen with substantially axially extending bars adhered thereto, and rotating foils at relatively high speeds past said inlet side of said screen and said bars.

5. A pressurized paper making stock screen comprising:

a substantially cylindrical screen having a longitudinal axis, means for feeding under pressure to an inlet side of said cylindrical screen a suspension of liquid, paper making fibers and undesirable rejects, means for removing from said screen a substantial portion of said undesirable rejects, means defining a plurality of slots disposed substantially normally with respect to said screen axis, said slots having a narrowest portion of from 0.001 to 0.008 inch, and means for generating immediately adjacent to said inlet side of said screen a field of high intensity, fine scale turbulence.

6. The screen of claim 5 wherein said turbulence generating means comprises:

elongated members projecting from said inlet side of said screen, and means mounted for movement adjacent and parallel to said inlet side of said screen and said elongated members.

7. The screen of claim 5 wherein said slots comprise:

a plurality of axially spaced slots which are circumferentially continuous about an outlet side of said screen.

8. The screen of claim 7 wherein: said slots are defined by a plurality of axially spaced rings.

9. The screen of claim 5 wherein:

said slots comprise a continuous slot helically disposed with respect to said axis of said screen.

10. The screen of claim 9 wherein:

said slots comprise a continuous strand extending helically about said axis of said screen.

* * * * *